US008069525B2

(12) United States Patent
Brenken

(10) Patent No.: US 8,069,525 B2
(45) Date of Patent: Dec. 6, 2011

(54) ROLLER BRUSH AND METHOD FOR PRODUCTION THEREOF

(75) Inventor: Rudolf Brenken, Büren (DE)

(73) Assignee: Wöhler Brush Tech GmbH, Bad Wünnenberg (DE)

( * ) Notice: Subject to any disclaimer, the term of this patent is extended or adjusted under 35 U.S.C. 154(b) by 367 days.

(21) Appl. No.: 11/990,568

(22) PCT Filed: Sep. 12, 2006

(86) PCT No.: PCT/DE2006/001619

§ 371 (c)(1),
(2), (4) Date: Feb. 14, 2008

(87) PCT Pub. No.: WO2007/033643

PCT Pub. Date: Mar. 29, 2007

(65) Prior Publication Data

US 2009/0223011 A1 Sep. 10, 2009

(30) Foreign Application Priority Data

Sep. 26, 2005 (DE) ..... 10 2005 046 035

(51) Int. Cl.
*A46B 7/10* (2006.01)
*A46B 3/00* (2006.01)
*A46D 3/00* (2006.01)

(52) U.S. Cl. ..... 15/182; 15/179; 300/21

(58) Field of Classification Search ..... 15/179, 15/181–183; 300/21
See application file for complete search history.

(56) References Cited

U.S. PATENT DOCUMENTS

| | | | | | |
|---|---|---|---|---|---|
| 2,576,546 | A | * | 11/1951 | Starr | 300/21 |
| 3,200,430 | A | * | 8/1965 | Haracz | 15/183 |
| 3,233,272 | A | * | 2/1966 | Pambello | 15/182 |
| 3,290,714 | A | * | 12/1966 | Enchelmaier et al. | 15/182 |
| 3,464,077 | A | * | 9/1969 | Hunt | 15/182 |
| 3,486,796 | A | * | 12/1969 | Lechene | 300/21 |
| 5,016,311 | A | * | 5/1991 | Young et al. | 15/88.3 |
| 5,819,357 | A | * | 10/1998 | Gould | 15/182 |
| 6,175,985 | B1 | | 1/2001 | Chambers et al. | |

FOREIGN PATENT DOCUMENTS

| | | |
|---|---|---|
| DE | 19 56 004 | 5/1971 |
| DE | 197 41 068 | 2/1999 |

OTHER PUBLICATIONS

Search Report dated Apr. 12, 2007 issued for the underlying International PCT Application No. PCT/DE 2006/001619.

* cited by examiner

*Primary Examiner* — Mark Spisich
(74) *Attorney, Agent, or Firm* — Cozen O'Connor

(57) ABSTRACT

In a process for the production of a roll brush the first step consists of extruding a retaining profile 2 of plastic, which through the fill 3 with bristles forms a strip brush 1 as an intermediate product, the strip brush 1 being subsequently helically wound on a winding mandrel 4 with the adjoining side faces 6,7 of the retaining profiles 2 being glued or fused to form a roll brush.

21 Claims, 1 Drawing Sheet

ROLLER BRUSH AND METHOD FOR PRODUCTION THEREOF

CROSS-REFERENCE TO RELATED APPLICATIONS

This is a U.S. national stage of International Application No. PCT/DE2006/001619, filed on 12 Sep. 2006. Priority is claimed on German Application No. 10 2005 046 035.6, filed on 26 Sep. 2005.

BACKGROUND OF THE INVENTION

1. Field of the Invention

The invention concerns a roll brush and a process for the production thereof.

2. Description of the Related Art

Roll brushes are both well known and proven in a number of different types. To a large degree the production of roll brushes is made by stitching or punching and stapling a brush fill to a pre-drilled brush core. The fill density is hereby limited to the maximal given number of holes.

Likewise the axial length of such roll brushes is given by that of the roll brush core.

In an alternative production method, strip brushes with a bristle fill retaining metal profile are spirally wound to a roll brush package. In order to ensure sufficient stability of such a brush the retaining profiles are welded. As this is done with a welding device the industrial production of such roll brush packages requires their inner diameter to be adequately large. A correspondingly large diameter must also be given at the winding mandrel, on which the strip brush is helically wound to a roll brush. Apart from the given minimal inner diameter the maximum possible axial length is also dictated by that of the winding mandrel. Furthermore, in such a brush no homogeneity of the materials used is possible, as the retaining profile must be made of metal.

Facing this technical background, the invention is concerned with providing a process for the production of a roll brush and hence providing a roll brush, produced according to this process, through which the aforementioned disadvantages can be avoided.

SUMMARY OF THE INVENTION

This technical problem is solved by a process for the production of a roll brush according to a first variant in the process of extruding a retaining profile of plastic, which by the fill with bristles forms a strip brush as an intermediate product, and the subsequent helical winding of the strip brush on a winding mandrel with the adjoining side faces of the retaining profiles being glued and/or fused to form a roll brush.

In an alternative process bristles of plastic are at the one end glued and/or fused and/or melted on together, forming a continuous retaining profile and so that a strip brush results as an intermediate product, the strip brush then being helically wound on a winding mandrel with the adjoining side faces of the retaining profiles being glued and/or fused.

Both processes have common and extensive advantages. According to both processes roll brushes can be produced completely out of a single plastic, offering corrosion resistance and resistance to acids and alkalines. No damage can be caused to the product to be brushed by metal parts in the brush as there are none. A roll brush produced in accordance with either of the processes of this invention can also be made foodstuff compatible, as oils, lubricants and parting agents are required neither in the production of the retaining profile nor the roll brush itself.

If the retaining profile and the bristles are of the same plastic then this homogeneity makes a later recycling of roll brush core and fill material unproblematic.

It can be designed for the helical winding to be made directly following extrusion and gluing and/or fusing and/or melting on of the bristle ends, at a time when the retaining profiles are due to the production process comparatively soft and in particular still glueable themselves. It is however favorable that retaining profile is made of an elastic plastic so that the production of the strip brush as an intermediate product can be made independently of the helical winding process. Suitable plastics, for example polypropylene and the like, are sufficiently well known.

A great advantage of the processes of this invention is that the strip brush as an intermediate product can equally be produced in a continuous length. Likewise, the roll brush can also be produced in a continuous length on the winding mandrel, by pressing the finished roll brush at the one end from the winding mandrel while it is wound at the other end, so that a given package size can be produced by cutting a continuous roll brush to length following this process. As a result the axial length of the winding mandrel will regularly be shorter than the axial length of the roll brush.

In a further definition of the production processes it can be designed for the roll brush to be multiply wound. This would enable a very fast production of roll brushes with a great axial length. Furthermore, it is possible to wind strips with various different bristle fills, so that the structure of a roll brush can vary along its axial length.

The design of the cross section of the retaining profiles is less critical. A retaining profile should on the one hand securely hold the bristle fill, which may be in a very high fill density, while also having side faces in a form suitable for gluing and/or fusing. According to the plastic material used, the specialist can select a suitable gluing or plastic fusing process, in order to attach the side faces of the retaining profiles together. The gluing and/or fusing of the side faces can be made under pressure and/or with heat.

An alternative offers the possibility of spiral winding before polymerization of the extruded retaining profile or hardening of the bristle ends formed to a retaining profile is completed, so that a gluing and/or fusing is equally determined by the production of the retaining profile.

A particular roll brush produced by such a process is characterized by the retaining profile formed of plastic and the brush core formed by adjoining side faces of the retaining profiles being glued and/or fused together.

In a roll brush of this invention the retaining profile can be formed by the bristle ends themselves being melted on and/or glued together, or alternatively by a separate extrudate.

The brush core can be made of multiple strips, whereby a particular consideration is to have strips formed of various different bristles.

The bristles and brush core should preferably be of the same plastic, so that recycling of a roll brush of this invention is unproblematic, as a homogeneity of materials is given.

The roll brush and the production process thereof of this invention will be further described by the help of a single drawing, solely displaying schematic examples.

DETAILED DESCRIPTION OF THE PREFERRED EMBODIMENTS

Figure 1:
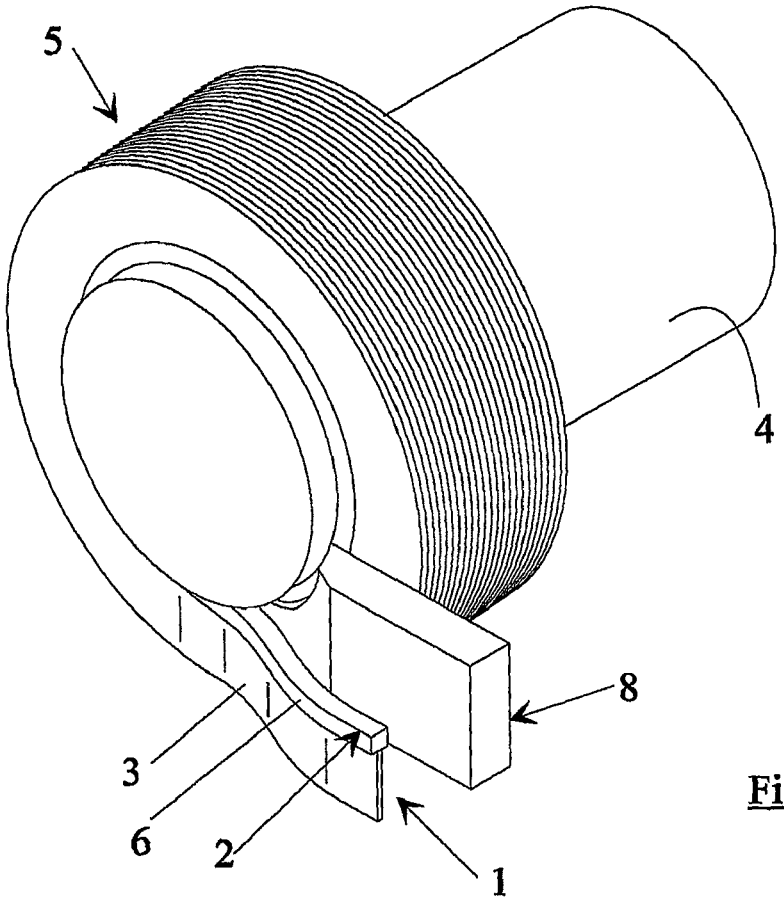
FIG. 1 schematically pictures helical winding of a strip brush on a winding mandrel.

FIG. 1 pictures the spiral winding of a strip brush 1 produced in continuous length, in which a bristle fill 3 is held by a retaining profile 2 of plastic. The winding of the strip brush 1 is carried out on a winding mandrel 4. With increasing axial length of the roll brush 5, this can be pushed beyond the axial length of the winding mandrel 4, as during winding the side faces 6,7 of the retaining profile 2 are glued and/or fused together. Compare with FIG. 2, wherein a self-supporting brush core results, which can also be used without shaft.

The process of this invention also makes the production of a roll brush 5 in any axial length possible, as simply cutting of the continuous roll brush is required.

Gluing of the side face 6,7 can be made with the aid of a suitable device 8, for example under pressure and/or heating.

Figure 2:
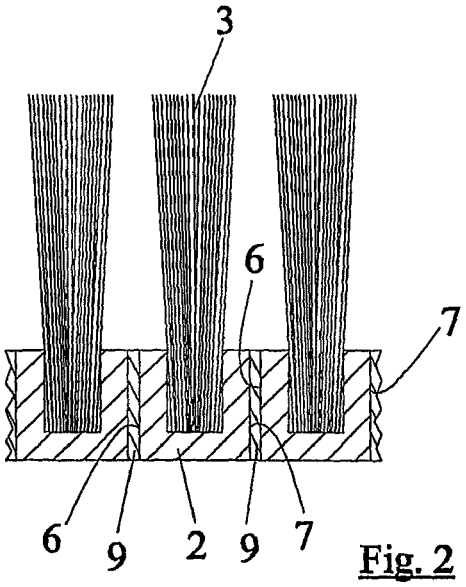
FIG. 2 pictures a first cross section of a retaining profile filled with bristles.

FIG. 2 pictures an axial section through the roll brush 5. Schematically shown is an extruded retaining profile 2 with a fill 3 of bristles. The adjoining side faces 6,7 are glued and/or fused together, indicated by a connecting layer 9.

Figure 3:
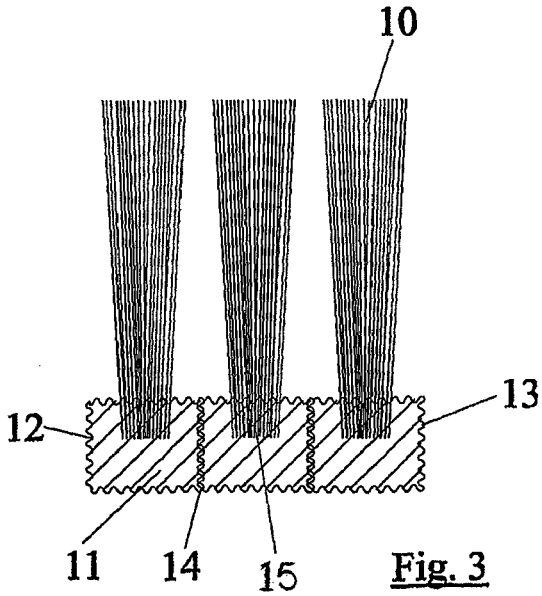
FIG. 3 shows a further variant example in cross section.

FIG. 3 pictures an alternative variant of the strip brush as an intermediate product for the production of a roll brush.

A retaining profile 11, holding the bristle fill 10 is made in this variant by gluing and/or fusing and/or melting of the ends 15 of the bristle fill 10 of plastic. During helical winding on the winding mandrel, the side faces 12,13 of the retaining profile 11 are again glued and/or fused, indicated by a connecting layer 14.

What is claimed is:

1. A process for manufacturing a roll brush, the process comprising:

extruding a retaining profile of plastic, the retaining profile having opposed side faces;

filling the retaining profile with bristles to form a strip brush as an intermediate product;

winding the strip brush helically on a mandrel so that one side face of the retaining profile contacts the other side face of the retaining profile;

joining the side faces by at least one of gluing and fusing to form a roll brush; and removing the formed roll brush from the mandrel such that the retaining profile alone forms a core of the roll brush after the steps of joining and removing from the mandrel.

2. The process of claim 1 wherein the roll brush is produced in a continuous axial length, the process further comprising cutting the roll brush to produce a roll brush having a desired length.

3. The process of claim 1 wherein the mandrel has an axial length which is shorter than the axial length of the roll brush.

4. The process of claim 1 comprising producing at least one additional said strip brush and multiply winding said strip brushes on said mandrel to form said roll brush.

5. The process of claim 4 wherein the strip brushes are filled with respective different bristles.

6. The process of claim 1 wherein the side faces are joined under pressure.

7. The process of claim 1 wherein the side faces are joined using heat.

8. The process of claim 1 further comprising, after winding the strip brush helically on a mandrel, polymerizing the extruded retaining profile.

9. A process for manufacturing a roll brush, the process comprising:

joining together ends of bristles;

forming a continuous retaining profile from the joined together ends, the retaining profile having opposed side faces, thereby forming a strip brush as an intermediate product;

winding the strip brush helically on a mandrel so that one side face of the retaining profile contacts the other side face of the retaining profile;

joining the side faces by at least one of gluing and fusing to form a roll brush; and removing the formed roll brush from the mandrel such that the retaining profile alone forms a core of the roll brush after the steps of joining and removing from the mandrel.

10. The process of claim 9 wherein the roll brush is produced in a continuous axial length, the process further comprising cutting the roll brush to produce a roll brush having a desired length.

11. The process of claim 9 wherein the mandrel has an axial length which is shorter than the axial length of the roll brush.

12. The process of claim 9 comprising producing at least one additional said strip brush and multiply winding said strip brushes on said mandrel to form said roll brush.

13. The process of claim 12 wherein different bristles are used to form respective said strip brushes.

14. The process of claim 9 wherein the side faces are joined under pressure.

15. The process of claim 9 wherein the side faces are joined using heat.

16. The process of claim 9 further comprising, after winding the strip brush helically on a mandrel, polymerizing the retaining profile.

17. A roll brush comprising at least one helically wound strip brush, each said strip brush consisting essentially of:

a plastic retaining profile helically wound and having opposed side faces wherein each said side face contacts and is joined by gluing or fusing to an adjacent said side face to form a self-supporting core of the roll brush; and a plurality of plastic bristles having ends which are fixed in the retaining profile, the bristles extending radially outward from the retaining profile, wherein the plastic retaining profile alone forms the self-supporting core of the roll brush, a bottom portion of the retaining profile being free of attachment to any other member of the roll brush and defining an exposed inner surface of the self-supporting core of the roll brush.

18. The roll brush of claim 17 wherein the retaining profile is formed by melting the ends of the bristles.

19. The roll brush of claim 17 comprising at least two helically wound strip brushes.

20. The roll brush of claim 19 wherein the strip brushes are filled with respective different bristles.

21. The roll brush of claim 19 wherein the bristles and the self-supporting core are made of the same plastic.

* * * * *